US008616391B2

(12) United States Patent
Pfenniger

(10) Patent No.: US 8,616,391 B2
(45) Date of Patent: Dec. 31, 2013

(54) TEAT

(75) Inventor: Erich Pfenniger, Ebikon (CH)

(73) Assignee: Medela Holding AG, Baar (CH)

( * ) Notice: Subject to any disclaimer, the term of this patent is extended or adjusted under 35 U.S.C. 154(b) by 188 days.

(21) Appl. No.: 12/482,257

(22) Filed: Jun. 10, 2009

(65) Prior Publication Data

US 2009/0314737 A1 Dec. 24, 2009

Related U.S. Application Data

(63) Continuation of application No. PCT/CH2009/000048, filed on Feb. 6, 2009.

(30) Foreign Application Priority Data

Jun. 12, 2008 (CH) ..... 0897/08

(51) Int. Cl.
*A61J 9/04* (2006.01)

(52) U.S. Cl.
USPC ..... 215/11.1; 215/11.4; 215/11.5

(58) Field of Classification Search
USPC ..... 215/12.1, 12.4, 12.5
See application file for complete search history.

(56) References Cited

U.S. PATENT DOCUMENTS 633,343 A * 9/1899 Heany ..... 215/11.1
689,987 A * 12/1901 Pick ..... 215/11.5
1,569,693 A * 1/1926 Young ..... 215/11.4
1,656,157 A * 1/1928 Correnti ..... 215/11.1
2,661,001 A * 12/1953 Alstadt et al. ..... 215/11.5
5,101,991 A * 4/1992 Morifuji et al. ..... 215/11.1
5,478,325 A 12/1995 Fu-Hsiang
5,897,007 A * 4/1999 Schein et al. ..... 215/11.1
6,126,679 A * 10/2000 Botts ..... 606/236

FOREIGN PATENT DOCUMENTS

EP 1779833 A1 5/2007
GB 07179 0/1913
GB 934534 8/1963
GB 2418867 A 4/2006

* cited by examiner

*Primary Examiner* — Tri Mai

(74) *Attorney, Agent, or Firm* — McDonnell Boehnen Hulbert & Berghoff LLP

(57) ABSTRACT

A teat has a main body, a mouthpiece with a suction opening, and at least one milk channel extending from the main body to the suction opening. During use, the mouthpiece has an upper side directed towards a palate of a baby, and a lower side directed towards the baby's tongue. It is designed, on its upper side, with at least two walls, and with at least one air space arranged between said walls. The at least one air space extends separately from the at least one milk channel. The mouthpiece is designed on the upper side in such a way that this at least one air space inflates in the presence of an under-pressure. This allows the palate, tongue and teat to interact in a manner that imitates breastfeeding.

13 Claims, 8 Drawing Sheets

TEAT

CROSS-REFERENCE TO RELATED APPLICATIONS

This application claims priority to International Application No. PCT/CH2009/000048 filed Feb. 6, 2009 and also claims priority to Swiss Patent Application No. 00897/08 filed Jun. 12, 2008. The entire disclosure content of these applications are herewith incorporated by reference into the present application.

BACKGROUND OF THE INVENTION

The invention relates to a teat.

A baby ideally drinks from its mother's breast. However, there are various reasons why this is not always possible. For many years now, attempts have therefore been made to develop teats for feeding bottles that allow the baby to feed as naturally as possible. The baby should be able to switch back and forth between the mother's breast and a feeding bottle as far as possible without confusion. Importance is attached to, among other things, the baby not being able to accidentally interrupt the flow of milk by pressing the mouthpiece of the teat too strongly together. In the early stages of the development of teats, another main aim was to ensure that the teat does not cause any lasting damage in the baby's mouth.

For this reason, the teaching of U.S. Pat. No. 1,590,152 is that the previously used teats comprising a long mouthpiece should be replaced by teats that the baby can no longer pull lengthwise. This published document also states that teats are known that have a hollow nipple, in which case the mouthpiece is provided with a thicker wall in order to ensure that it does not completely collapse during feeding.

U.S. Pat. No. 1,605,427 discloses a teat whose mouthpiece is reinforced by a hollow cylindrical insert part. The insert part has radial ribs on its inner face. This insert part is intended to avoid a situation where the mouthpiece is compressed and milk can no longer flow through.

U.S. Pat. No. 4,586,621 discloses a teat with a semi-rigid inner membrane and a thin elastic outer membrane. During feeding, this outer membrane is filled with milk via the opening in the semi-rigid membrane and thus begins to swell.

U.S. Pat. No. 5,101,991 discloses a teat whose mouthpiece is designed with a double wall. The inner wall forms a hollow cylinder which extends concentrically with respect to the centre axis of the mouthpiece and hangs freely down. At the bottom, in the direction towards the feeding bottle, this hollow cylinder is closed, except for a small through-opening.

In JP 2002011076, ultrasound images were used to examine how the natural feeding action of a baby actually appears. It is proposed that a teat be made available whose mouthpiece has zones of increased extensibility. This teat would then reach farther into the child's palate region, similarly to the nipple during natural breastfeeding of the baby. In a first variant, the mouthpiece not only has these zones of increased extensibility, but is also provided with axially extending ribs that allow milk to flow through even when the teat is compressed. In a second variant, instead of the ribs, an inner hollow cylinder is integrally formed on the tip of the mouthpiece and projects in the direction of the feeding bottle.

U.S. Pat. No. 6,966,904 discloses a teat with a milk channel which extends within the teat and which is formed by a separate tube. U.S. Pat. No. 7,320,678 discloses a variant in which the inner milk channel is formed in one piece with the teat. Both teats have a valve for regulating the flow of milk.

SUMMARY OF THE INVENTION

It is an object of the invention to make available a teat that permits feeding that is as natural as possible.

This object is achieved, for example, by a teat having the features of the claimed invention.

Tests during breastfeeding have shown that there are important aspects other than the extensibility of the mouthpiece during feeding and the avoidance of closure of the milk channel. The interaction of teat, palate and tongue is also important. The teat according to the invention takes into account the natural interaction of palate, tongue and nipple. Since the teat has an air space or chamber that inflates cyclically during feeding, the teat, just like is believed to be the action of the mother's nipple, is able to follow the tongue and/or palate movement of the baby and optimally fill the oral cavity as the mother's nipple does.

In a preferred embodiment, the air space does not just inflate in a direction perpendicular to the longitudinal axis of the teat. By virtue of its three-dimensional increase in size, the mouthpiece (nipple part) of the teat is lengthened and extends as far as the soft palate of the child.

The teat according to one embodiment of the invention permits simulated feeding that is as true to nature as possible, such that nipple confusion when changing from the teat to the mother's breast can be avoided.

The teat according to the invention has a main body with an inlet opening, a mouthpiece with a suction opening, and at least one suction channel extending from the inlet opening to the suction opening. A baby can suck a liquid, in particular milk, through the suction channel. The mouthpiece has at least one extensible zone which extends separately from the at least one suction channel and which, during use, lies between the palate and tongue of a baby. This zone is designed in such a way that it expands, in particular inflates, in the presence of an underpressure (negative pressure) generated in the baby's mouth during sucking.

This extension is preferably reversible, such that the zone expands cyclically during feeding, and according to the feeding rhythm, and its volume is then reduced again.

The mouthpiece, in particular the suction channel, is preferably flexible. The suction channel is preferably just as soft as, or even softer than, the outer wall of the mouthpiece. This soft and flexible configuration permits optimal adaptation of the radial teat shape to the baby's feeding action, since the mouthpiece is able to optimally follow the tongue and/or palate movement. Moreover, this configuration also allows the mouthpiece to lengthen during feeding. The lengthening of the mouthpiece is preferably also reversible during and in accordance with the feeding cycle.

In a preferred embodiment, the mouthpiece, during use, has an upper side directed towards a palate of a baby, and a lower side directed towards the baby's tongue, and it is designed, on its upper side, at least double-walled with two walls, and the at least one zone is arranged between these two walls.

This zone is preferably a chamber or space which is open or closed with respect to the main body and which is filled with air, a gas, a liquid or a foam. If the chamber is filled with foam, then this itself is expandable in the presence of an underpressure or it has chambers that are filled with gas, in particular air, and that expand in the presence of an underpressure.

In a preferred embodiment, the teat according to the invention has a main body, a mouthpiece with a suction opening, and at least one suction channel or milk channel that extends from the main body to the suction opening. The mouthpiece has a peripherally closed outer wall, and a peripherally closed inner wall adjoining the outer wall in the area of the suction opening, and the inner wall, on its inner face directed towards its longitudinal centre axis, forms the at least one milk channel. According to an aspect of the invention, the at least one air space extends separately from the at least one suction channel and contains spacers.

The teat according to the invention takes into account the interaction of palate, tongue and teat. In particular, during the feeding phase in which the rear area of the tongue is lowered, it allows the teat to bear with practically its entire upper surface completely on the baby's palate. Moreover, the teat bears with practically its entire lower surface on the baby's tongue during the feeding phase in which the rear area of the tongue is raised.

Ultrasound images of a baby feeding at its mother's breast have shown that the baby switches cyclically between two feeding phases. In phase A, the rear area of the baby's tongue is raised and presses against the hard palate. In phase B, this rear area of the tongue is lowered. The ultrasound images have also shown that the nipple is pulled lengthwise until just before the transition from the hard palate to the soft palate. The baby generates an underpressure in its mouth by moving the rear area of its tongue downwards in phase B. The upper lip on the one hand, and the tongue and/or the lower lip on the other hand, form a tight seal to the outside. The baby's soft palate helps to maintain the underpressure during feeding. The soft palate forms a pharyngeal seal so as to maintain the vacuum in the oral cavity. In phase A, the nipple has a coronal cross section in the form of an ellipse, the major semi-axis lying horizontally. In phase B, the nipple is pretensioned by the maximum vacuum and has an approximately round cross section. By means of the cyclical upward and downward movement of the tongue, the diameter of the nipple thus changes in the same cycle. The coronal cross section changes its shape cyclically, with the cross-sectional surface area in phase B being slightly reduced compared to that in phase A. The teat according to the invention now simulates this effect.

The at least one air chamber of the teat, preferably at atmospheric pressure, inflates (expands) in the presence of an external underpressure. In this way, the external diameter increases like the nipple. The air chamber changes its volume in the same cycle as the baby lifts and lowers its tongue. If at least the upper side of the teat is provided with such an air chamber, this ensures that the teat bears on the baby's hard palate during phase B, just like the nipple.

The air space, or, in the case of several air chambers, at least one of these air chambers, can be open with respect to the main body. This embodiment is easy and therefore inexpensive to produce. However, at least one of these air chambers, or all of them, can also be closed with respect to the main body. This embodiment ensures that the "balloon effect" is fully achieved in any event, i.e. the chamber inflates.

In a preferred embodiment, the at least one air space extends in a ring shape about a longitudinal centre axis of the mouthpiece and is thus also located on the lower side of the teat directed towards the baby's tongue.

The air space can extend along only part of the length of the mouthpiece. However, it preferably extends along the entire length. It is also possible for several air spaces to be arranged over one another and distributed along the length of the mouthpiece, in which case these air spaces are completely separate from one another and do not permit any exchange of air between them. However, they can also be configured such that an exchange of air is possible.

A plurality of milk channels can be present. However, it is preferable for there to be a single milk channel, which extends coaxially along the longitudinal centre axis of the mouthpiece.

In a preferred embodiment, the air space contains spacers, for example ribs, which, when the mouthpiece is pressed together, preserve this air space in a smaller form. This avoids a situation where the walls of the mouthpiece could remain stuck together and the air space would no longer be able to inflate in the next cycle. The spacers are preferably projections that are arranged on at least one of the walls of the mouthpiece and are oriented towards the air space. However, they can also be grooves. The projections can extend at a constant height. However, their longitudinal direction preferably runs in the axial direction. In a preferred embodiment, they extend along almost the entire length of the air space.

It is another objective of the invention to provide a feeding nipple for a liquid medium, comprising, a member having an internal channel with a delivery opening at one end for outflow of liquid and an inlet opening at another end for ingress of liquid. The member has an expansible chamber defined in part of said member, with the chamber being located in use between a user's palate and tongue. The chamber in use encloses a volume of air therein, whereby upon movement of the tongue in a manner that is away from the palate, a negative pressure is created in a region adjacent to the chamber causing the chamber to expand.

Yet another objective of the invention is to provide a feeding nipple for a liquid medium, comprising an elongated flexible member having an internal channel with a delivery opening at one end for outflow of liquid and an inlet opening at another end for ingress of liquid, with an expansible chamber defined in part of the flexible member. That chamber is located in use in a user's mouth between a user's palate and tongue, and encloses a volume of air therein. Upon movement of the tongue in a manner that is away from the palate a negative pressure is created in a region adjacent to the chamber causing the chamber to expand.

In an embodiment according to the foregoing, the feeding nipple's flexible member is formed in a double-walled structure having an interior wall defining the channel, and an exterior wall outboard to and surrounding the interior wall. The walls meet at the one end and define a proximal boundary for the chamber thereat, with the walls defining an orifice to the chamber at a distal position. The exterior wall and the interior wall are compressible together at the distal position in use to temporarily substantially seal off a volume of air within the chamber for expansion thereof upon tongue movement.

In a preferred form of the foregoing embodiment, the feeding nipple channel is further initially closed at the distal position when the walls are compressed together, and then reopens upon the movement of the tongue to create the negative pressure.

There is associated with the foregoing invention a method for improved feeding through a nipple, comprising the steps of: providing a reservoir of liquid for feeding; providing a feeding nipple communicating with the reservoir, the feeding nipple having a flexible teat portion with a liquid channel defined therein for conveying liquid from a reservoir to a dispensing end of the teat, the teat further having an expansible chamber formed in the teat along a portion that is received between a user's palate and tongue; closing the channel at a distal position relative to the dispensing end by action of a user's mouth; causing the chamber to expand by movement of a user's tongue away from the palate in a manner that generates a negative pressure in a region adjacent to the chamber causing the chamber to expand, whereupon the channel reopens to convey liquid therethrough.

An embodiment that is easy to produce and easy to clean has a peripherally closed outer wall, a peripherally closed inner wall adjoining the outer wall in the area of the suction opening, and a flange adjoining the free end of the inner wall. The inner wall, on its inner face directed towards its longitudinal centre axis, forms the at least one milk channel. The flange is oriented radially outwards from the inner wall. It can, for example, be hinged sealingly into an opening of a receiving head of a teat unit, in order to form the at least one separate air space between outer wall and inner wall. However, it can also close the air space in another way, for example by extending as far as an outer wall of the teat and being connected thereto in a sealed manner.

Further advantageous embodiments are set forth in the dependent patent claims.

BRIEF DESCRIPTION OF THE SEVERAL VIEWS OF THE DRAWINGS

The subject matter of the invention is explained below on the basis of preferred illustrative embodiments shown in the attached drawings. In the drawings.

DETAILED DESCRIPTION OF THE INVENTION

Figure 1:
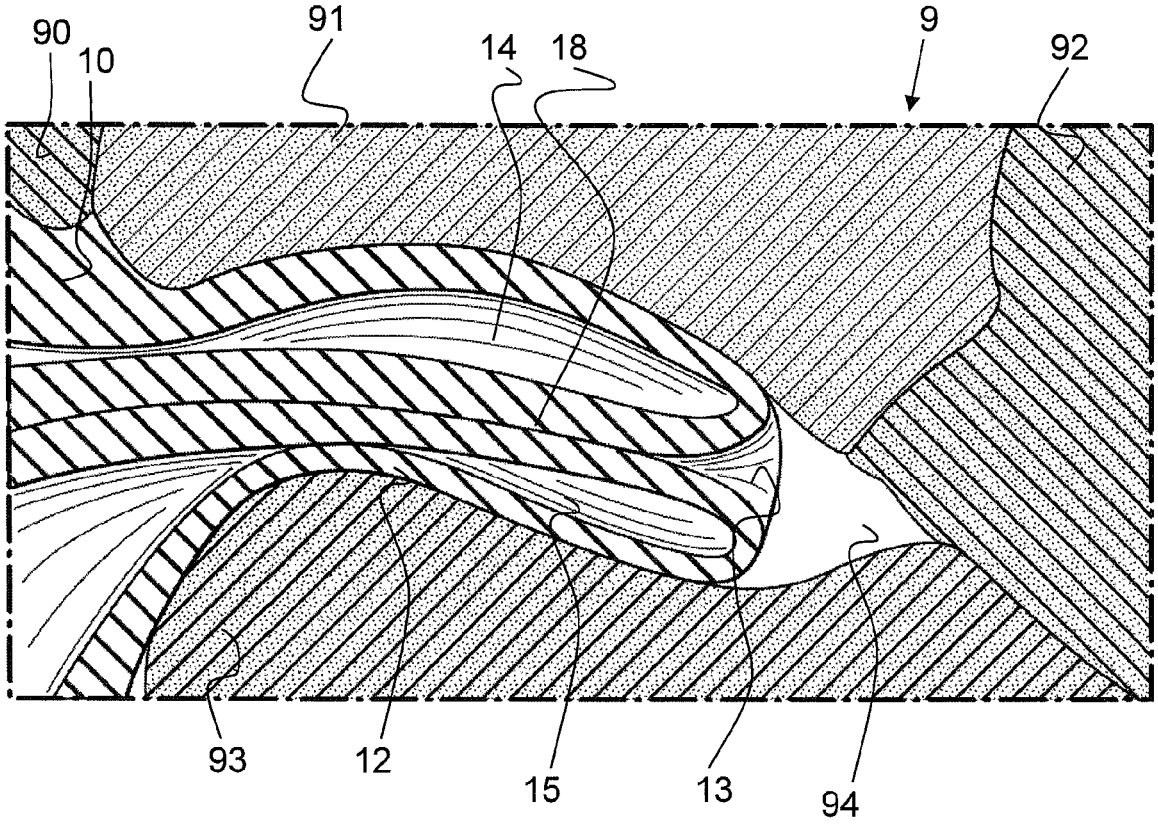
FIG. 1 shows a schematic view of a baby's mouth while feeding on a teat according to the invention.

FIG. 1 shows a schematic view of the feeding action of a baby. Reference number 9 indicates the baby's mouth, reference number 90 shows the upper lip, reference number 91 indicates the hard palate, and reference number 92 indicates the soft palate. The baby's tongue is indicated by reference number 93.

A mouthpiece 12 of a teat 1 according to the invention is located in the baby's mouth 9. The front part of the tongue 93 and/or the lower lip, on the one hand, and the upper lip, on the other hand, enclose the teat 1 sealingly from the outside. The mouthpiece 12 reaches into the mouth 9 almost as far as the transition from the hard palate 91 to the soft palate 92. The front part of the tongue 93 presses against the mouthpiece 12 from below, while the rear part of the tongue 93 is lowered. A hollow space 94 forms in the rear area, as a result of which an underpressure is generated in the mouth 9.

An upper area of the mouthpiece 12 forms an extensible zone 14 which bears on the hard palate 91. This zone 14 is preferably a fluid-filled chamber or an air space. In the text that follows, air space is used instead of zone. Other types of zones can equally be provided. In particular, instead of being filled with air, the space can be filled with another gas, with a liquid or with a foam.

The air space 14 bears substantially along its entire length on the hard palate 91. Since the air chamber 14 extends substantially along the entire length of the mouthpiece 12, in the example shown here the mouthpiece 12 bears along its entire length on the hard palate 91.

The lower area of the double-walled mouthpiece 12 is pressed together, and a front air space 15 is also present here. However, this does not necessarily have to be present. As can be seen from FIG. 1, the underside of the mouthpiece 12 also nestles preferably on the tongue 93.

A milk channel 18 extending within the mouthpiece 12 is shown almost completely closed here. This does not necessarily have to be the case. The flow of milk, however, is substantially interrupted in this situation. A suction opening of the teat 1 is provided with reference number 13.

Figure 2A:
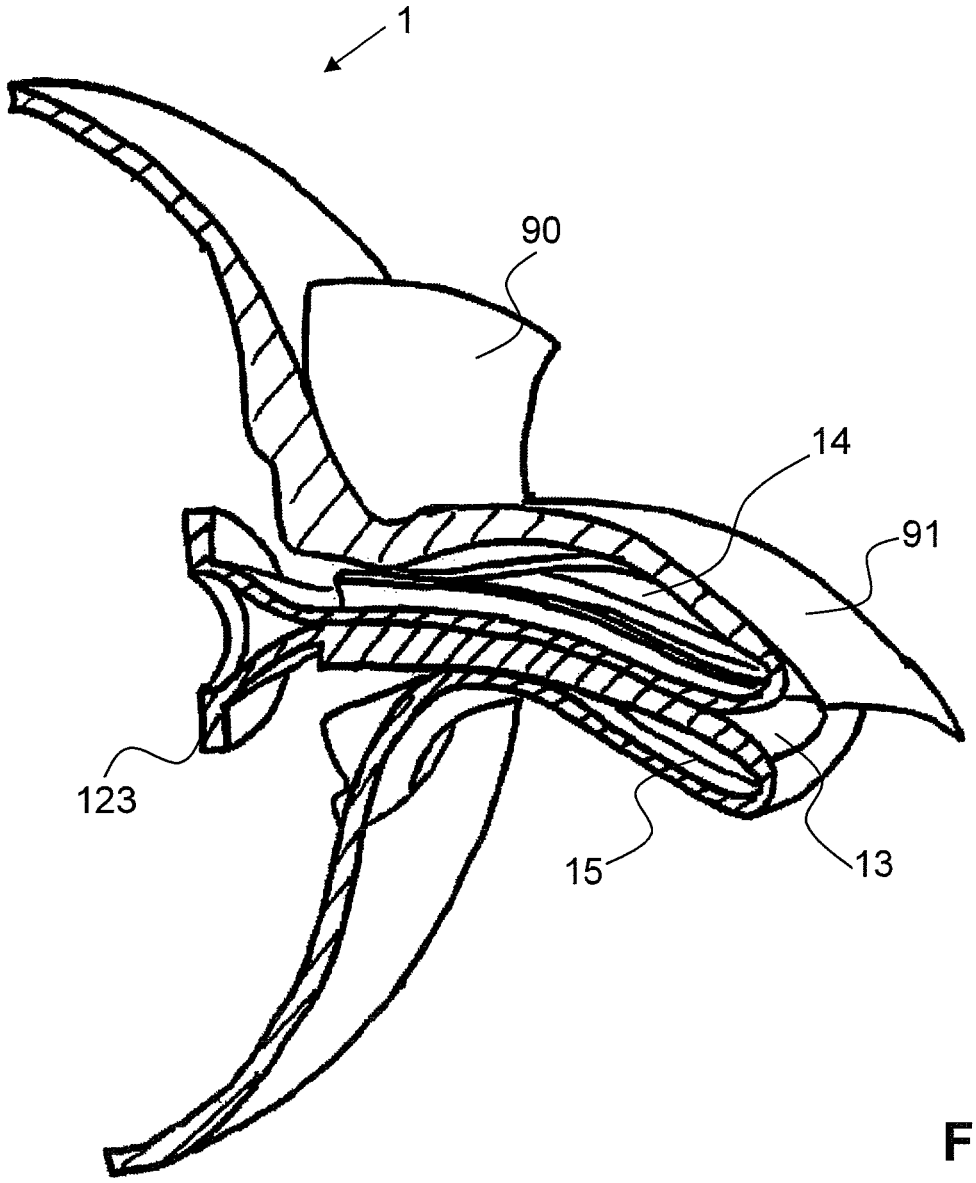
FIG. 2*a* shows a schematic view of the teat according to the invention and of the palate during feeding phase B, when the rear area of the baby's tongue is lowered.
Figure 2B:
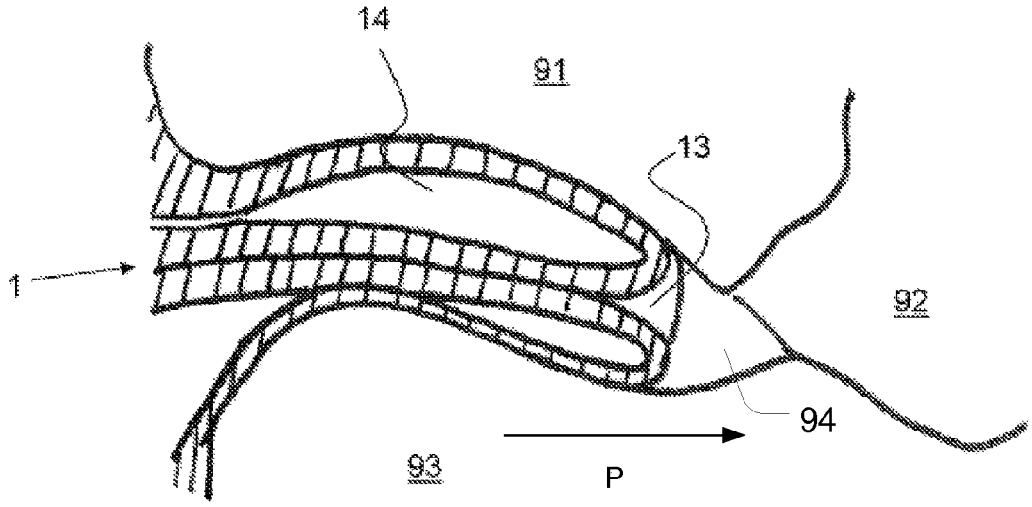
FIG. 2*b* shows another view of the teat in feeding phase B.

The same situation is shown in FIGS. 2*a* and 2*b*.

Figure 3B:
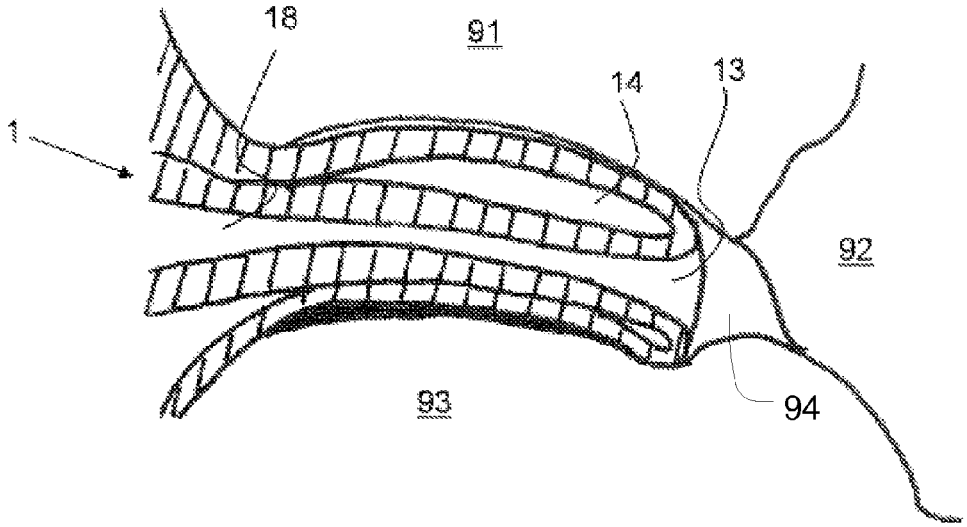
FIG. 3*b* shows another view of the teat in feeding phase A.
Figure 3A:
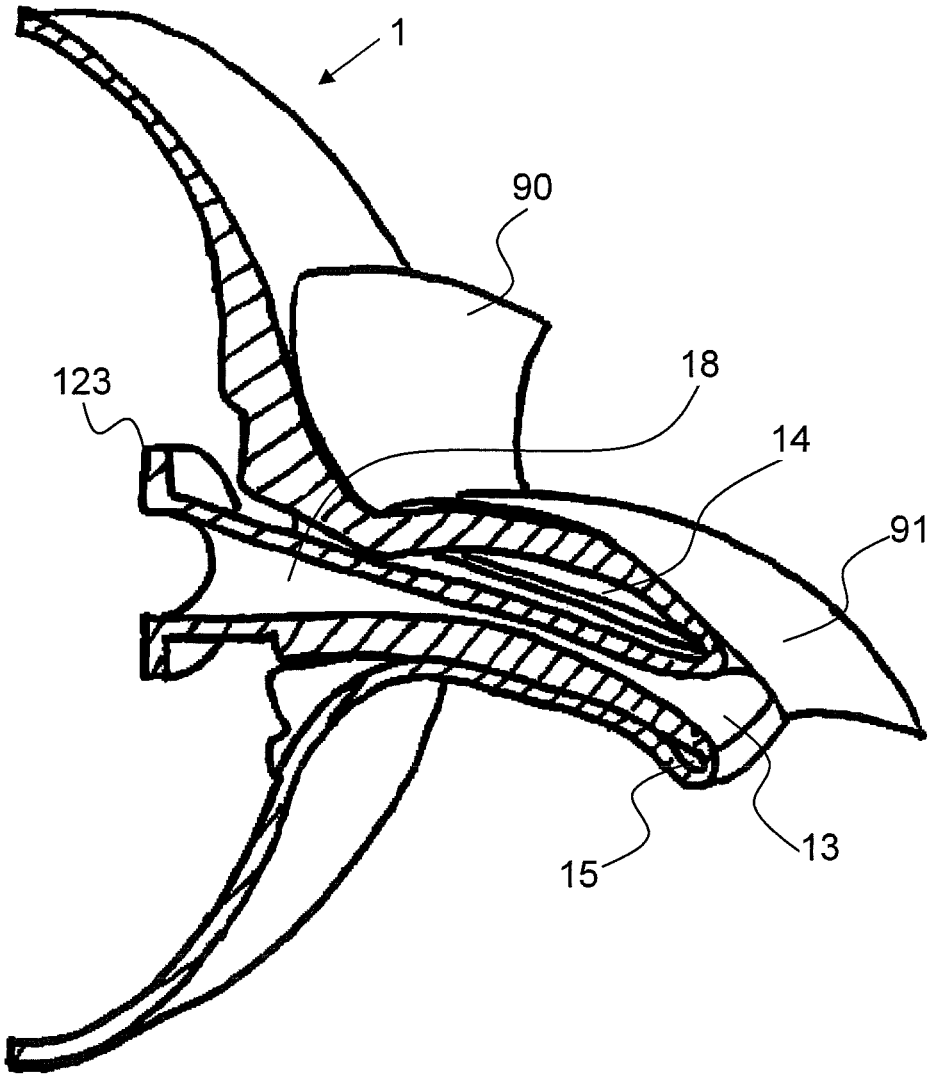
FIG. 3*a* shows the teat and palate according to FIG. 2 during feeding phase A, when the rear area of the tongue is raised.

FIGS. 3*a* and 3*b* now show the situation in which the tongue 93 is raised in the rear area. The lower air space 15 is made smaller or entirely disappears, depending on the shape of the mouthpiece 12. The pressure on the part of the mouthpiece at the lips is slightly reduced. The upper air space 14 is compressed but is still retained, albeit with a reduced volume. This is because of the spacers that are arranged in the air space 14. These spacers are described in more detail later in the text. The upper air chamber 14 and the upper part of the mouthpiece 12 bear as before on the hard palate 91. The same applies to the lower part of the mouthpiece 12, which likewise bears on the tongue (not shown).

As it sucks on the teat 1, the baby now switches between the positions shown in FIGS. 2 and 3, as a result of which an underpressure is generated cyclically, as if by a pump, and the milk channel is then opened. The direction of the change in negative pressure is shown by arrow P in FIG. 2*b*. The upper air space 14 and if appropriate also the lower air space 15 extend on account of the vacuum, similar to a balloon placed in a vacuum chamber. The change in volume of the air spaces 14, 15 takes place cyclically with the change of the underpressure prevailing in the mouth. This ensures that the mouthpiece 12 of the teat 1 behaves similarly to a natural nipple.

At least one upper air space 14 is preferably present at least on the upper side of the mouthpiece 12. However, at least one lower air space 15 is also preferably present on the lower side of the mouthpiece 12. It is also possible for several air spaces to be present on both sides. The upper and lower air spaces 14, 15 can be connected to one another or can even be formed by the same space, such that the mouthpiece 12 has a rotationally symmetrical design.

The air spaces 14, 15 are preferably at atmospheric pressure. They can have an open design and thus communicate with the outside of the teat 1. As can be seen in FIGS. 1 and 2, the lip 90, the hard palate 91 and the tongue 93 preferably close off the air spaces 14, 15 from the outside.

However, the air spaces 14, 15 can also have a closed design. In this case, they can also have an overpressure relative to the atmospheric pressure or can have an underpressure, as long as this underpressure is much less (i.e. closer to the atmospheric pressure) than the underpressure generated in the baby's mouth.

The teat 1 according to the invention and in particular its mouthpiece 12 with the at least one air space 14 can have a wide variety of shapes. By way of example, FIGS. 4 to 10 show an illustrative embodiment of a teat 1 according to the invention. However, the teaching according to the invention is not limited to a teat of this kind. In particular, the double walls and the air space 14 can also be configured in another way. Spacers or non-adhering surface design is advantageous, but not absolutely necessary. Moreover, although the method of securing described here is preferred, it is not the only way by which such a teat can be secured on a feeding bottle. In particular, it is also possible to use the securing methods known from the prior art.

Figure 4:
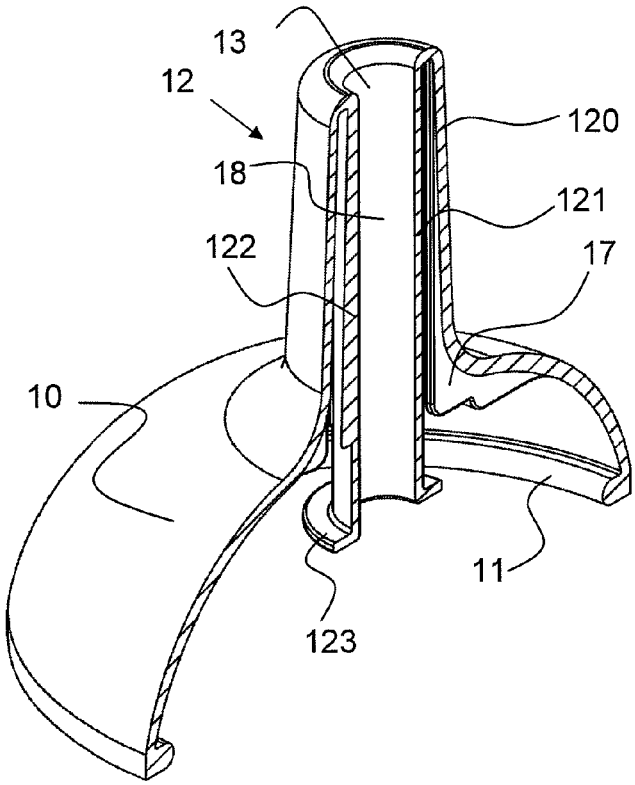
FIG. 4 shows a perspective view of a longitudinal section through the teat according to the invention.
Figure 5:
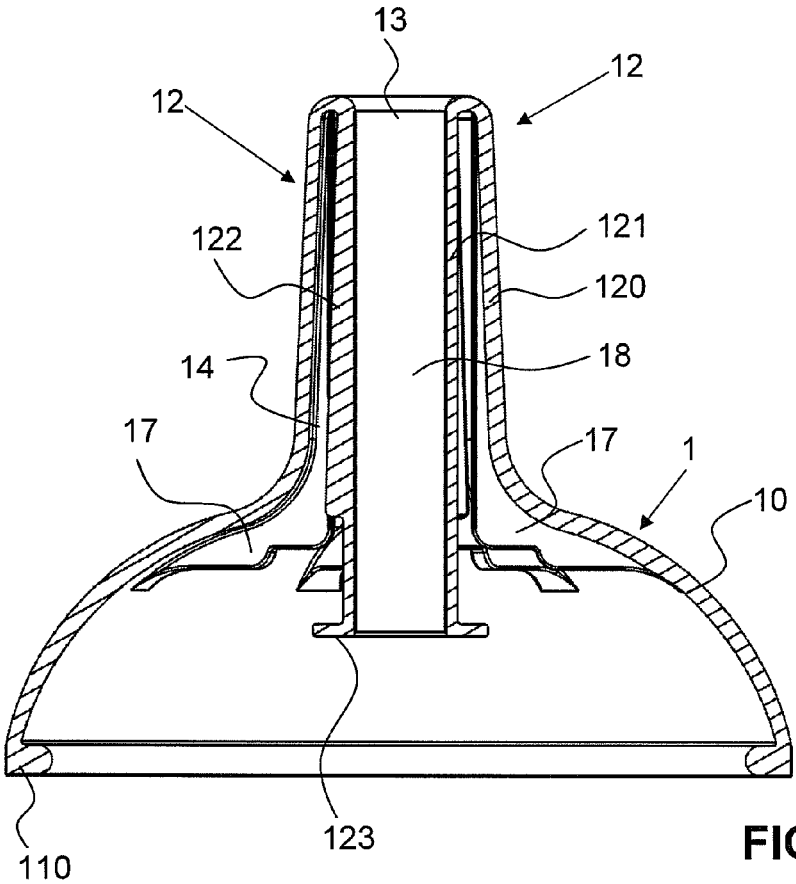
FIG. 5 shows a longitudinal section through the teat according to FIG. 4.

FIGS. 4 and 5 show a teat 1 according to the invention. It is preferably made of silicone, of a silicone-based plastic, rubber, TPE or another suitable material. It is preferably designed in one piece. It has a spherical cap-shaped main body 10, which narrows to a cylindrical or frustoconical mouthpiece 12 comprising a free end. Extending within the mouthpiece 12 there is at least one, in this case precisely one, suction channel or milk channel 18, which is rectilinear and ends in a suction opening 13 at the tip of the mouthpiece 12. The liquid flows from this suction opening 13 out of the teat 1. The main body 10 is preferably hollow. An inwardly projecting securing flange 11 is formed integrally at the broad lower end of the main body 10 lying remote from the mouthpiece 12.

The mouthpiece 12 is designed with a double wall. It has a closed outer wall 120 extending about its complete circumference. The upper end of this outer wall 120 is adjoined by an inner wall 121, which is preferably produced in one piece with the outer wall 120. However, it can also be welded or otherwise tightly connected thereto. The inner wall 121 is likewise closed and extends about a full circumference. It projects downwards in the direction of the main body 10 and extends at least along the entire length of the outer wall 120. It preferably protrudes with its lower end partially into the main body 10. The lower end of the inner wall 121 is adjoined by a flange 123, which is likewise produced preferably in one piece with the latter or is subsequently connected thereto.

The main body 10, outer wall 120 and inner wall 121 can have the same wall thickness or different wall thicknesses and/or a different extensibility. The individual parts 10, 120, 121 can have varying wall thicknesses or extensibilities within themselves. The inner wall 121 preferably has more or less the same degree of flexibility as the outer wall 120. It can also be made softer or stiffer than the outer wall 120. It should not at any rate lead to a substantial stiffening of the mouthpiece.

Between the outer wall 120 and the inner wall 121, an air space 14 is formed which surrounds the entire milk channel 18 but extends separately from the latter. That is to say, no milk flows through the air space 14.

In this air space 14, at least in one area, spacers are arranged which are preferably distributed uniformly about the circumference of the milk channel 18 and ensure that the outer wall 120 and the inner wall 121 cannot bear on each other along their entire common length under an external pressure. In this way, the air space, even under external pressure, has a minimum volume that is not equal to zero. In addition, the outer wall 120 and the inner wall 121 do not stick to each other even when the external pressure has ceased.

In this example, the spacers are formed by ribs 122, 17 that protrude into the air space 14. They can be arranged either on the inner wall 121 or on the outer wall 120, and particularly formed integrally thereon. In this example, inner ribs 122 are arranged protruding radially outwards on the inner wall 121, and outer ribs 17 are arranged protruding radially inwards on the outer wall 120. They are preferably offset relative to each other all round the circumference and uniformly distributed about said circumference. The ribs 122, 17 additionally strengthen the walls.

In this example, the longitudinal direction of the ribs runs in the direction of the longitudinal centre axis of the mouthpiece 12 or milk channel 18. However, the ribs can also be arranged extending around the milk channel 18, for example extending around it at a constant height or winding around it in a spiral shape. Instead of ribs, it is also possible to use knobs, grooves or other kinds of elevations and depressions that interrupt the plane and smooth surface of the inner wall 121 and/or of the outer wall 120.

FIGS. 6 to 10 show how such a teat can be integrated in a teat unit and how the latter can be secured on a feeding bottle.

Figure 8:
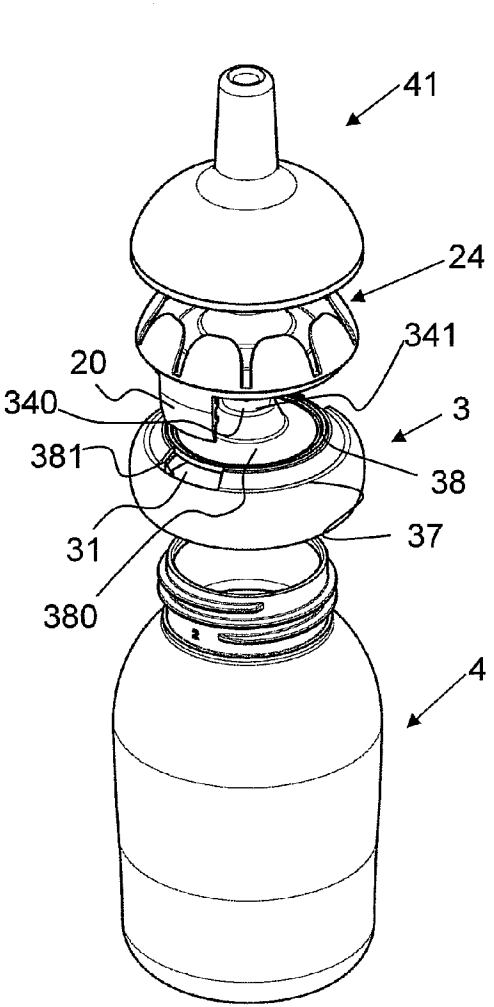
FIG. 8 shows a perspective view of the teat unit and feeding bottle according to FIG. 6.
Figure 7:
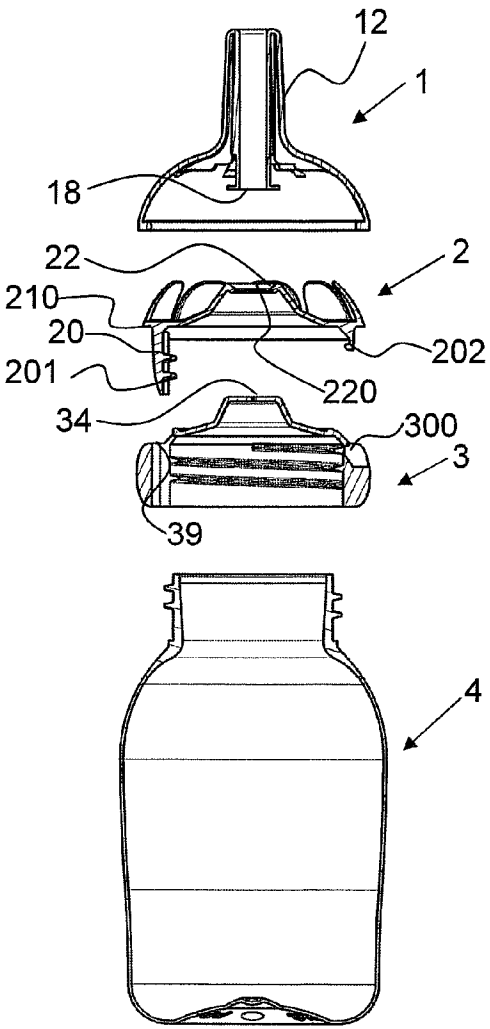
FIG. 7 shows a longitudinal section through the teat unit and feeding bottle according to FIG. 6.
Figure 6:
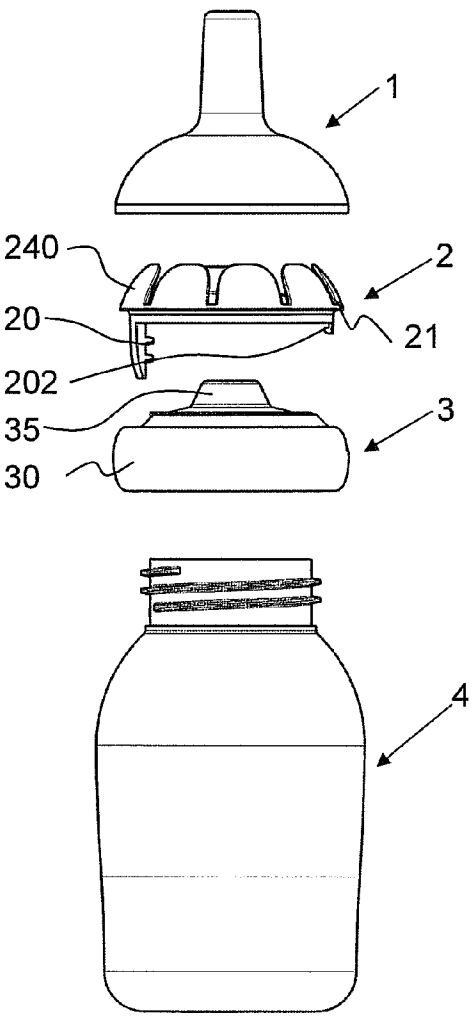
FIG. 6 shows a side view of a teat unit with the teat according to the invention and with a feeding bottle, in an exploded view.
Figure 9:
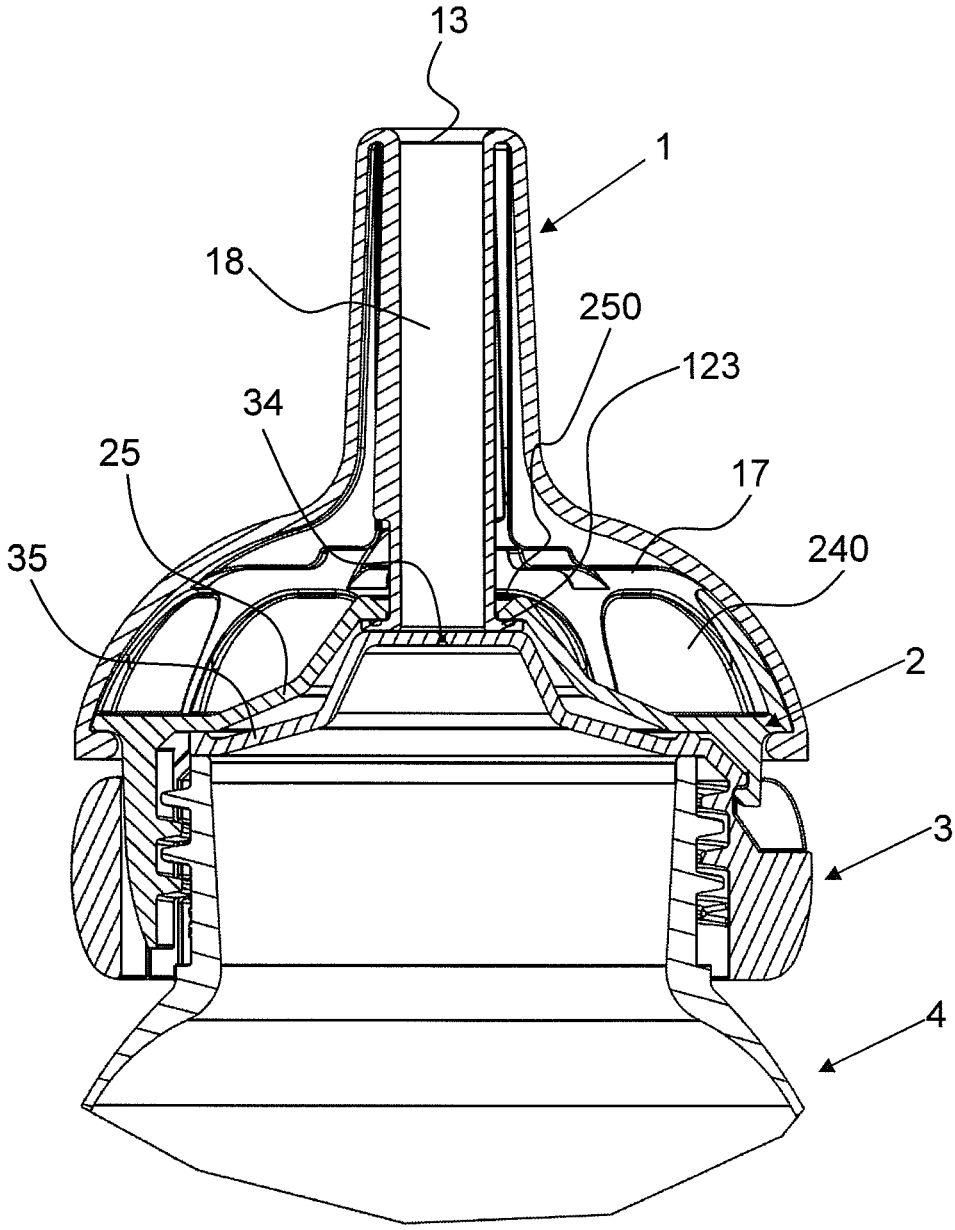
FIG. 9 shows a longitudinal section through the teat unit with fitted teat according to FIG. 6.
Figure 10:
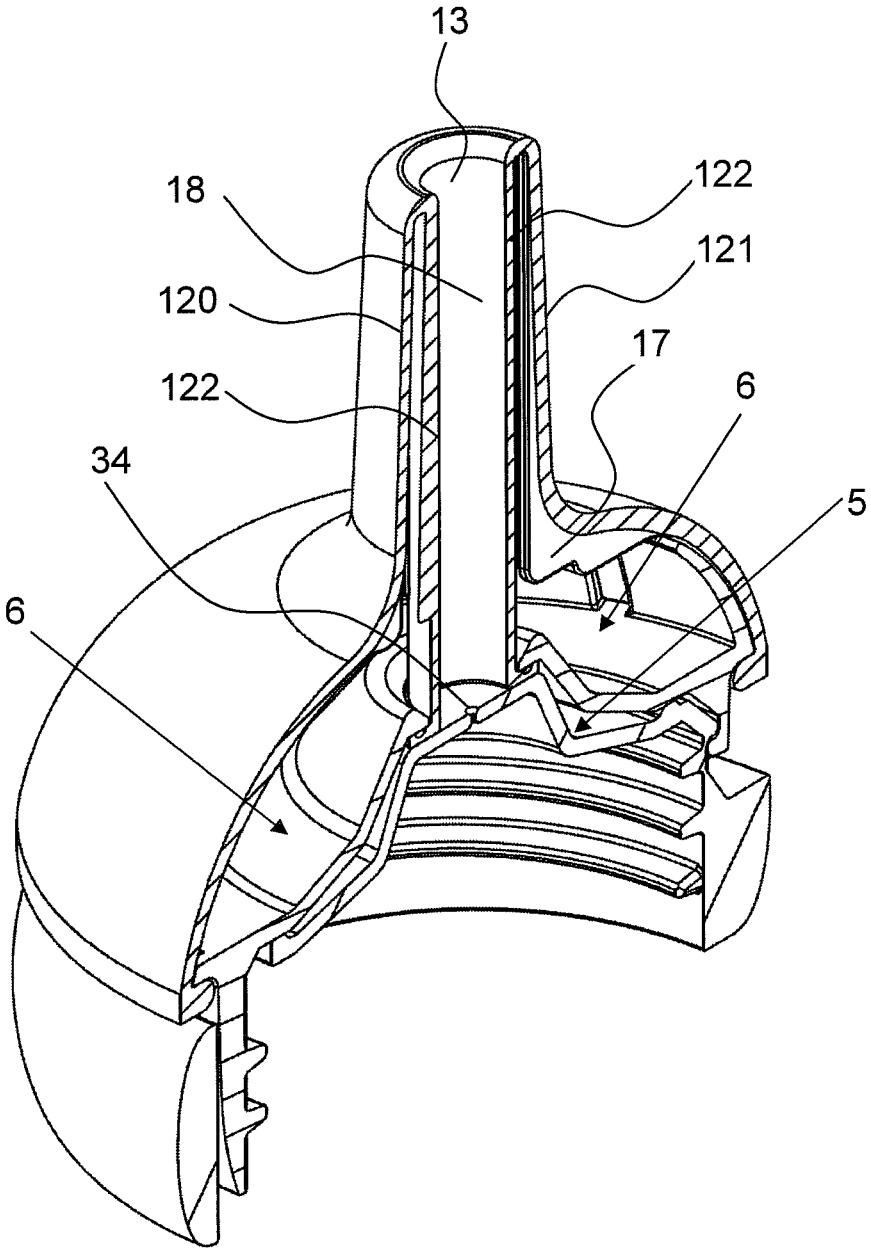
FIG. 10 shows a perspective view of the longitudinal section according to FIG. 9.

FIGS. 6 to 8 show an example of a feeding bottle 4. Other types and shapes of drink containers can be used with the teat units according to the teaching of the invention. However, they preferably have a container neck with an outer thread.

The teat unit is composed of the teat 1 and of the in this case two-part teat connector, which comprises a base part 3 and a receiving head 2. The base part 3 is preferably made of polypropylene (PP) or a polyamide, the receiving head 2 is made of PP or a polyamide or a combination of PP or a polyamide with silicone, rubber or TPE.

The base part 3 is dimensionally stable, i.e., substantially rigid, and is made of a stiff material. It is composed principally of an annular body 30 with a circumferential, closed outer jacket, which preferably provides sufficient grip to allow it to be used as a rotary ring when the teat unit is being fitted onto or removed from the container 4.

At least one slit 31 is arranged in the peripheral edge of the annular body 30. The slit is designed with a curve matching the radius of the annular body 30. The slit 31 extends to the inner wall of the annular body 30. The distance between opposite wall areas (measured through the centre point of the annular body 30) is equal to or preferably greater than the external diameter of the thread of the container 4.

On the top face of the base ring 3 directed away from the container neck, there is an outer peripheral sealing edge 37 which projects upwards. It is preferably formed by the uppermost peripheral edge of the base ring 3. At a distance from the outer sealing edge 37, there is an inner peripheral sealing edge 38, which likewise projects upwards. The slit 31 is thus located between the first and second sealing edge 37, 38. This sealing edge 38 is preferably interrupted by at least one vent opening 381, which leads to the outside. The outward route can, for example, lead to the feeding bottle 4 via a non-tight thread connection or can extend between base part 3 and receiving head 2.

An inner truncated cone 35 is formed integrally in the base part 3 within the inner sealing edge 38 and in the upper area. Its flanks can be rectilinear or curved. It protrudes above the annular body 30 and extends upward towards the receiving head 2. The through-opening 34 is preferably arranged in the uppermost area, preferably in the flattened tip. This tip can have a cylindrical jacket and extend across the through-opening 34, such that it forms an upper sealing edge 340. A plane surface 341 is located in the interior of this sealing edge 340. A peripheral inner sealing surface 380 adjoins the lower area of the inner truncated cone 35 and of the inner sealing edge 38. It extends preferably perpendicular to the longitudinal centre axis of the base part 3.

This base part 3 can be fitted onto the container neck, but without already being positionally fixed relative to the latter, in particular secured against rotation. A lower abutment 39 is present which limits how far the neck of the container can pass through the base part 3, i.e. how far the base part 3 can slip down onto the neck of the container. In the examples shown here, the abutment is an inner contact surface 39 in the upper area of the base ring 3. Other types of abutments 39 are also possible, for example projecting lugs or ribs.

The receiving head 2 is also annular and preferably rotationally symmetrical and has a central through-opening 22. It is composed principally of two areas. The lower area is formed by at least one plug element 20. The plug element 20 has an inner thread 201 on its inner face. Instead of an inner thread, an outer thread can also be present if the drink container 4 is provided with a corresponding inner thread.

The receiving head 2 can be plugged into the base part 3, with the plug element 20 engaging in the slit 31. Locking noses on the plug element 20 and/or on the slit 31 can prevent the receiving head 2 from subsequently falling out of the base part 3. The length of the plug element 20 is preferably dimensioned such that it extends approximately to the lower edge of the base part 3 but does not protrude beyond this.

Arranged on that side of the receiving head 2 lying diametrically opposite the plug element 20, there is a hinge 202 which engages in a corresponding recess 300 of the base part 3. A releasable plug connection is thus provided without the receiving head 2 and base part 3 having to be completely separated from each other. They can be cleaned together, but in an open position.

However, by gently pulling the receiving head 2 and base part 3 apart in the direction of their common longitudinal centre axis, the resistance of the locking ribs can be overcome and they move past each other. The release action is made easier if the plug element 20 is designed to be slightly resilient. Resiliency can be achieved, for example, by a suitable choice of the thickness of the plug element 20, i.e. the material thickness. However, the two parts can preferably be separated from each other only when they are not screwed onto the container 4.

The upper area of the receiving head 2 has peripherally arranged support bodies 24 that engage with the above-described teat 1. In this example, the peripheral support structure 24 is formed by supporting wings 240 which are distributed uniformly about the circumference and are arranged in the peripheral area. They protrude upwards and obliquely inwards like petals. In this example, they each have a substantially rectangular basic shape, with their edges being rounded. These supporting wings 240 are preferably stiff. They can be resilient, non-resilient or only slightly resilient. They are formed particularly in one piece with the rest of the receiving head by an injection moulding method or other suitable production method. However, the supporting wings 240 can also be made of a softer material than that of the plug elements 20. Even if they are relatively soft, however, they are preferably dimensionally stable. Instead of the petals, it is also possible, for example, to use completely solid knobs as support structure.

Below the supporting wings 240, i.e. in the transition area from the upper part to the lower part of the receiving head 2, the underside directed towards the base part 3 and container 4 has a protruding peripheral securing edge 21 with a peripheral outer sealing surface 210. It is plane and extends approximately perpendicular to the longitudinal centre axis of the receiving head 2.

The receiving head 2 has, in its interior, an outer truncated cone 25 which projects upward towards the teat 1 and in whose flattened tip the through-opening 22 is arranged. The uppermost area of the truncated cone 25 is surrounded by a bead, which limits a peripheral groove 250.

A valve can be arranged in the interior of the tip of the outer truncated cone 25. This is not absolutely necessary. In this embodiment a valve diaphragm 220 is shown. It closes the relatively small through-opening 22.

As has been described above, the main body 10 of the teat 1 is curved inwards with its lower edge such that the radially inwardly directed flange 11 is formed. The teat 1 can be pushed with its main body 10 over the supporting wings 240 of the receiving head 2, the upper part of the receiving head 2 being enclosed by the teat 1. The flange 11 engages behind the protruding edge between the upper and lower areas of the receiving head 2 and bears flat on the outer sealing surface 210 of the latter.

The teat 1 can thus be plugged onto the receiving head 2 and pushed partially over it. The receiving head 2 can then be plugged into the base part 3. The receiving head 2 can be plugged into the base part 3 when the latter is free, but also when it is already located on the neck of the container. Since the base part 3 can still be moved slightly in the axial direction relative to the receiving head 3, it is also possible for the teat 1 to be pushed over the receiving head 2 only after receiving head 2 and base part 3 have been plugged together.

If the teat 1 is now pushed over the receiving head 2, its radially outwardly projecting and peripheral flange 123 engages in the opening 22 of the receiving head 2 and forms a leaktight connection. This engagement of the flange 123 can be seen clearly in FIGS. 9 and 10.

When the receiving head 2 is plugged into the base part 3, the outer truncated cone 25 surrounds the inner truncated cone 35, and the two through-openings 34, 22 are preferably flush with each other in the longitudinal centre axis. In the assembled state, the suction opening 13 is connected to the interior of the container via the through-openings 22, 34 of the receiving head 2 and of the base part 3, such that the baby is able to take its drink, for example tea, water or milk, through this opening.

If a valve diaphragm is used, then the surface 341 of the base part 3 forms the valve seat for the diaphragm 220. An encircling space 5 between the two truncated cones 25, 35 is created, said space 5 being formed by the fact that the two truncated cones 25, 35 do not have the same inclination. This space forms a vent chamber 5. At least one vent opening or air release opening 381 preferably leads out from this chamber 5.

Between the teat 1 and the receiving head 2, a support space 6 is formed which deforms depending on the stress applied to the teat 1 by the baby. The outer truncated cone 25 projects as far as the mouthpiece 12 and forms a central supporting body. The mouthpiece 12 is optimally supported in this way.

By rotating the base part 3 or the receiving head 2 on the neck of the container, the two threads, namely the outer thread and the inner thread 201, mesh with each other. The receiving head 2 runs downwards along the thread. The base part 3 is pulled down with it as far as its lower abutment. In the embodiments shown here, this means that it bears with its upper inner abutment surface 39 on the upper edge of the neck of the container. The base part 3 and receiving head 2 are now secured on the container 4 and secured against rotation relative to each other. In this way, the outer sealing surface 370 of the base part 3 is now pressed relative to the outer sealing surface 210 of the receiving head 2. They clamp the flange 11 of the teat 1 and thus ensure a liquid-tight and air-tight connection between teat 1, receiving head 2 and base part 3. Depending on the particular design, a differently shaped lower edge 11 of the teat 1 can be clamped sealingly between the two parts 2, 3.

If the bottle 4 is no longer needed, the base part 3 can be turned again such that the anti-rotation engagement between base part 3 and receiving head 2 is cancelled. By virtue of the axial displaceability of the base part 3, the flange 11 is released and the teat 1 can be removed from the receiving head 2. The plug connection between receiving head 2 and base part 3 can then be undone. The three parts can then be cleaned and, if appropriate, sterilized as individual parts.

The teat according to the invention permits an interaction of palate, tongue and teat that imitates natural breastfeeding.

The invention claimed is:

1. A teat having a main body with an inlet opening, a mouthpiece with a suction opening, and at least one suction channel extending from the inlet opening to the suction opening, wherein the mouthpiece has at least one extensible zone which extends separately from the at least one suction channel and which has no suction opening, and which, during use, lies between the palate and tongue of a baby, and wherein the at least one extensible zone is configured to expand in the presence of an underpressure generated in the baby's mouth during sucking, wherein the mouthpiece has a peripherally closed outer wall, a peripherally closed inner wall having a first end and a second end, wherein the first end adjoins the outer wall in the area of the suction opening, and a flange adjoining the second end of the inner wall, wherein the inner wall, on an inner face directed towards a longitudinal center axis, forms the at least one suction channel, and wherein the flange is oriented radially outwards from the inner wall, such that the flange can be hinged sealingly into an opening of a receiving head of a teat unit.

2. The teat according to claim 1, wherein the suction channel is flexible.

3. The teat according to claim 1, wherein the mouthpiece, during use, has an upper side directed towards a palate of a baby, and a lower side directed towards the baby's tongue, and wherein the upper side includes at least two walls, one of the two walls being the inner wall and one of the two walls being the outer wall and the at least one extensible zone is arranged between the inner and the outer wall.

4. The teat according to claim 1, wherein the suction channel extends coaxially along a longitudinal center axis of the mouthpiece.

5. The teat according to claim 1, wherein the at least one extensible zone extends in a ring shape about an axis or the longitudinal center axis of the mouthpiece.

6. The teat according to claim 1, wherein the extensible zone contains spacers which, when the mouthpiece is pressed together, preserve the extensible zone with a reduced volume.

7. The teat according to claim 6, wherein the spacers are projections that are arranged on at least one of the walls of the mouthpiece and are oriented towards the air space.

8. The teat according to claim 1, wherein the at least one extensible zone extends in the axial direction of the teat along almost the entire length of the mouthpiece.

9. The teat according to claim 1, wherein the inner wall extends along at least the entire length of the outer wall of the mouthpiece.

10. The teat according to claim 1, wherein the inner wall is longer than the mouthpiece and extends into the main body.

11. The teat of claim 1 wherein said extensible zone extends along the whole length of the mouthpiece.

12. A teat comprising a main body, a mouthpiece with a suction opening, and at least one suction channel extending from the main body to the suction opening, wherein the mouthpiece has a peripherally closed outer wall and a peripherally closed inner wall having a first end and a second end, wherein the first end adjoins the outer wall in the area of the suction opening, wherein the inner wall has an inner face directed towards a longitudinal center axis, and wherein the inner wall forms the at least one suction channel on the inner face, further comprising at least one zone which extends separately from the at least one milk channel, which zone has no suction opening and which zone is provided with spacers, wherein the inner wall has, at a second end, a flange which is oriented radially outwards from the inner wall, such that the flange can be hinged sealingly into an opening of a receiving head of a teat unit.

13. A feeding nipple for a liquid medium, comprising a member having an internal channel with a delivery opening at one end for outflow of liquid and an inlet opening at another end for ingress of liquid, an expansible chamber defined in part of said member, said chamber extending separately from the internal channel and being closed at the delivery opening, said expansible chamber being located in use between a user's palate and tongue, said expansible chamber in use enclosing a volume of air therein, whereby upon movement of the tongue in a manner that is away from the palate a negative pressure is created in a region adjacent to said expansible chamber causing said expansible chamber to expand wherein the member has a peripherally closed outer wall, a peripherally closed inner wall having a first end and a second end, wherein the first end adjoins the outer wall in the area of the delivery opening, and a flange adjoining the second end of the inner wall, wherein the inner wall, on an inner face directed towards a longitudinal center axis, forms the internal channel, wherein the inner wall and the outer wall form the expansible chamber therebetween and wherein the flange is oriented radially outwards from the inner wall, such that the flange can be hinged sealingly into an opening of a receiving head of a teat unit.

* * * * *